US005348830A

United States Patent [19]

Sacripante

[11] Patent Number: 5,348,830

[45] Date of Patent: Sep. 20, 1994

[54] POLIYMIDE TONER AND DEVELOPER COMPOSITIONS

[75] Inventor: Guerino G. Sacripante, Oakville, Canada

[73] Assignee: Xerox Corporation, Stamford, Conn.

[21] Appl. No.: 144,455

[22] Filed: Sep. 20, 1993

[51] Int. Cl.[5] ..... G03G 9/087

[52] U.S. Cl. ..... 430/109

[58] Field of Search ..... 430/109

[56] References Cited

U.S. PATENT DOCUMENTS

| | | | |
|---|---|---|---|
| 4,513,074 | 4/1985 | Nash et al. | 430/106.6 |
| 4,543,313 | 9/1985 | Mahabadi et al. | 430/109 |
| 4,560,635 | 12/1985 | Hoffend et al. | 430/106.6 |
| 4,701,389 | 10/1987 | Morimoto et al. | 430/110 |
| 4,891,293 | 1/1990 | Sacripante et al. | 430/109 |
| 4,973,539 | 11/1990 | Sacripante et al. | 430/109 |
| 5,021,316 | 6/1991 | Kubo et al. | 430/108 |
| 5,238,768 | 8/1993 | Ong | 430/110 |
| 5,275,903 | 1/1994 | Sundararajal et al. | 430/109 |

FOREIGN PATENT DOCUMENTS

| | | | |
|---|---|---|---|
| 204051 | 11/1984 | Japan | 430/109 |

OTHER PUBLICATIONS

Encyclopedia of Polymer Science and Engineering, Vol. 12, 2nd edition, Published by Wiley, (1985), pp. 364 to 383.

*Primary Examiner*—Roland Martin
*Attorney, Agent, or Firm*—E. O. Palazzo

[57] ABSTRACT

A toner composition comprised of a pigment, and thermotropic liquid crystalline polyimide of the formula

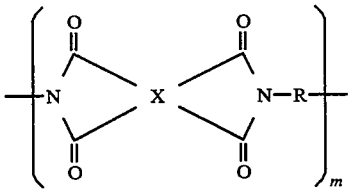

wherein m represents the number of monomer segments present; X is a symmetrical moiety independently selected from the group consisting of phenyl, naphthyl, cyclohexyl, or bicycloaliphatic; and R is independently selected from the group consisting of alkyl, oxyakylene and polyoxyalkylene.

23 Claims, No Drawings

POLIYMIDE TONER AND DEVELOPER COMPOSITIONS

BACKGROUND OF THE INVENTION

This invention is generally directed to toner and developer compositions, and more specifically, the present invention is directed to developer and toner compositions, including low melting toner compositions containing novel anisotropic or thermotropic liquid crystalline polyimide resins, and process for the preparation thereof. In embodiments, there are provided in accordance with the present invention, toner compositions comprised of thermotropic liquid crystalline polymide resins, or anisotropic polyimide resins, and pigment particles comprised of, for example, carbon black, magnetites, or mixtures thereof, cyan, magenta, yellow, blue, green, red, or brown components, or mixtures thereof thereby providing for the development and generation of black and/or colored images. In embodiments, there are provided in accordance with the present invention anisotropic or thermotropic liquid crystalline polyimide toner resins of the following formula and processes for the preparation thereof by melt condensation

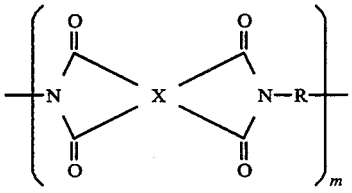

wherein X is a symmetrical mesogenic moiety or a cycloaliphatic radical attached to four imide carbonyl moieties, for example X can be

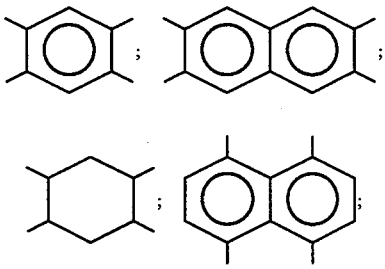

and

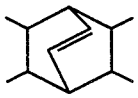

R is alkyl, alkylene with from about 1 to about 25 carbon atoms, such as methyl, ethyl, propyl, butyl, methylene, ethylene, propylene, butylene and the like, and preferably 1 to about 15 carbon atoms, oxyalkylene or polyoxyalkylene containing from about 1 to about 25, and preferably 1 to about 15 carbon atoms, and more specifically diethylene oxide, triethyleneoxide or polyoxypropylene, and the like; and m represents the number of segments and can be a number of from about 1 to about 10 to about 10,000. The X in the above formula can be phenyl, naphthyl, cyclohexyl, or bicycloaliphatic. The toner compositions of the present invention in embodiments possess a number of advantages, including low melting characteristics, blocking characteristics, possess excellent admix characteristics, have excellent nonvinyl-offset properties, and a low relative humidity sensitivity such as from about 1.01 to about 2.3. The resin composition of the present invention can in embodiments be generated by a process involving the melt polycondensation of about 1 mole equivalent of a symmetrical mesogenic dianhydride such as pyromellitic dianhydride (1,2,4,5-benzene tetracarboxylic dianhydride) or naphthalene dianhydride, and the like, and about 1 mole equivalent of an alkylene diamine, or preferably a diamino terminated alkylene oxide, such as a diaminoterminated polypropylene oxide or diaminoterminated polyethylene oxide, available from Texaco Chemicals as JEFFAMINE D-230 TM, D-400 TM, D-700 TM, EDR-148 TM, and EDR-192υ as illustrated by the formulas

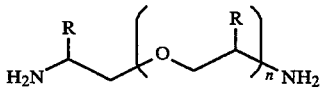

wherein

EDR-148 n=2; R=H
EDR-192 n=3; R=H
D-230 n=2,3; R=$CH_3$
D-400 n=5,6; R=$CH_3$

The aforementioned liquid crystalline polyimides of the present invention in embodiments exhibit a number average molecular weight of from about 1,500 to about 50,000, and preferably 20,000 grams per mole as measured by vapor phase osmometry, with a glass transition temperature of from about 40° C. to about 80° C., and more preferably of from about 50° C. to about 65° C. as measured by the Differential Scanning Calorimeter. In embodiments, the thermotropic liquid crystalline polyimide can be generated by a process of selecting from about 0.7 mole equivalent to about 1 mole equivalent of symmetrical mesogenic dianhydride, such as pyromellitic dianhydride, and from about 0.7 to about 1 mole equivalent of an alkylene diamine, or preferably a diaminoterminated alkylene oxide, such as the diaminoterminated polypropylene oxide or diaminoterminated polyethylene oxide available, from Texaco Chemical as JEFFAMINE TM, and optionally a kinking agent, such as a nonsymmetrical aromatic or cyclic monomer such as 1,3-cyclohexyldiamine present in an amount of from about 0.1 mole equivalent to about 0.3 mole equivalent and which depresses the liquid crystalline phase to a narrower liquid crystalline range, such as from about 1 to about 20° C. and which polymide resin possesses a number average molecular weight of from about 1,500 to about 50,000 grams per mole as measured by vapor phase osmometry, and with a glass transition temperature of from about 40° C. to about 70° C., and more preferably from about 50° C. to about 64° C. as measured by the Differential Scanning Calorimeter.

Examples of advantages of the toner composition of the present invention include low fusing temperatures, such as from about 120° C. to about 140° C., thus lower fusing energies are needed for fixing enabling less power consumption during fusing, and permitting extended lifetimes for the fuser system selected. Furthermore, the toner compositions of the present invention possess in embodiments a broad fusing latitude, such as from about 40° C. to about 100° C., with minimal or no release oil, which oil inhibits the toner from offsetting onto the fuser rollers usually associated with ghosting or background images on subsequent copies. Furthermore, the fused images obtained with the toner compositions of the present invention in embodiments do not substantially offset to vinyl covers, such as those utilized for notebook binders, and possess low humidity sensitivity ratio of from about 1 to about 2.3 calculated by the ratios of the triboelectric charge in microcoulombs per gram of the developer after being placed in a chamber of 20 percent humidity for 48 hours; to the triboelectric charge in microcoulombs per gram of the developer after being placed in a chamber of 80 percent humidity for 48 hours.

In designing resins for a toner composition, it is generally desired that the glass transition temperature of the resin be from about 50° C. to about 65° C., and preferably no less than about 55° C.; therefore, for example, the toner particles should not aggregate, coalesce or block during manufacturing, transport or storage process or until the toner is needed for fixing. Additionally, low fusing characteristics can be important, hence the resin should melt or flow a low temperature, such as from about 130° C. to about 145° C. Moreover, low relative humidity sensitivity of toners is desired such that the triboelectric charge is stable to changes in environmental humidity conditions. Copiers and printers equipped with two component developers, that is a toner as one component mixed with the carrier as the other component, can exhibit a positive or negative triboelectric charge with a magnitude of from about 7 microcoulombs per gram to about 40 microcoulombs per grams. This triboelectric charge permits the toner particles to be transferred to the latent image of the photoreceptor with an opposite charge, thereby forming a toned image on the photoreceptor, which is subsequently transferred to a paper or a transparency substrate, and thereafter subjected to fusing or fixing process. In these development systems, it is important for the triboelectric charge to be stable under differing environmental humidity conditions such that the triboelectric charge does not change by more than from about 5 to about 10 microcoulombs per gram. A change of more than from about 5 microcoulombs per gram to about 10 microcoulombs per gram in triboelectric charge of the toner developer can cause nonuniform toned images or result in no toning of the photoreceptor, thus unbalanced density or gray scale is observed in the developed images, or no developed images at all result. Generally, humidity ranges may differ from less than about 20 percent in dry regions to more than about 80 percent in humid regions, and some geographical regions may exhibit fluctuations of up to from about 50 to about 80 percent humidity level within the same day. In such climates, it is important that the developmental triboelectric charge does not change by more than from about 5 microcoulombs per gram to about 10 microcoulombs per gram. As toner resins generally represent from about 80 percent to about 98 percent by weight of toner, the resin sensitivity to moisture or humidity conditions should be minimized thereby not adversely affecting the triboelectric charge thereof. A number of toner polymeric resins utilized as toner compositions, such as for example styrene-acrylates, styrene-methacrylates, styrene-butadienes and especially polyesters contain from about 0.1 to about 2 percent by weight of moisture, and in many instances, the moisture content of polyesters may change from about 0.1 to about 4 percent by weight at humidity levels ranging from about 0 to about 100 percent, or preferably from about 20 percent to about 80 percent humidity. These changes in moisture content of the resin may have a dramatic adverse effect on the triboelectric charge of the toner developer. Relative humidity sensitivity of toner is customarily measured by first fabricating a toner comprised of a pigment, optional charge control agent and a resin, then admixing the toner from about 3 percent by weight to about 7 percent by weight with a carrier. The developer composition is then subjected to various humidity level in a sealed chamber for a finite period of time, such as about 48 hours. The triboelectric charge is then measured for the same developer composition with differing humidity levels and analyzed by several methods, such as graphing the triboelectric charge as a function of humidity level and observing the regions in which dramatic changes occur Another measuring method comprises dividing the aforementioned graphical interpolation of tribo vs humidity level in three regions, wherein region A is from about 0 to about 30 percent humidity, region B is from about 30 to about 65 percent humidity, and region C is higher than about 65 percent humidity to about 100 percent. Since these measurements are cumbersome and require timely consuming measurements, there can be measured the triboelectric charge after subjecting the toner developer composition to two humidity levels, such as 20 percent humidity and 80 percent humidity, and then calculating the relative sensitivity by taking the triboelectric charge ratio of the 20 to 80 percent humidity as given by the following Equation 1:

$$\text{Relative Humidity Sensitivity} = \frac{\text{Tribo Charge at 20\% RH}}{\text{Tribo Charge at 20\% RH}}$$

wherein RH is the relative humidity.

Thus, if the relative sensitivity is about 1.0, the toner composition is nonhumidity sensitive, whereas if the relative sensitivity is greater than from about 3, or greater than about 5, the toner composition is said to be very humidity sensitive. It is generally believed that a number of polymeric materials exhibit relative sensitivity greater than 1.0, and in general, styrene butadiene, or styrene acrylate possess relative humidity sensitivity of greater than 1.0 and less than about 2.5, whereas polyesters possess a relative humidity sensitivity of greater than 1.8 and less than about 5. Hence, an advantage of the styrene-acrylate or styrene-butadiene class of resins over polyesters is their lower relative sensitivity. Polyesters are known to display advantages over styrene based resins, such as low fixing temperatures of from about 120° C. to about 140° C., high gloss, such as from about 50 gloss units to about 80 gloss units, and nonvinyl offset properties. Therefore, there is a need for toner compositions comprised of a resin which possess all of the aforementioned advantages, such as low fixing of from about 120° C. to about 140° C., high gloss, such as from about 50 gloss units to about 80 gloss units, nonvinyl offset properties and in addition low relative humidity sensitivity, such as from about 1.0 to about 2.0. These and other advantages are attained in embodiments by the toner compositions of the present invention comprised of a pigment, optionally a charge control agent and a thermotropic liquid crystalline polyimide resin derived from a mesogenic dianhydride and organodiamine, which toner exhibits low fixing of from about 120° C. to about 140° C., high gloss, such as from about 50 gloss units to about 80 gloss units, nonvinyl offset properties and low relative humidity sensitivity, such as from about 1.0 to about 2.3.

Thermotropic liquid crystalline resins are known, such as those illustrated in U.S. Pat. No 4,543,313, the disclosure of which is totally incorporated herein by reference, which discloses toner and developer compositions with thermotropic liquid crystalline polyesters, polyamides, and polycarbonates. The '313 patent does not mention tetrasubstituted monomers such as pyromellitic anhydride, diamino alkane or diaminoalkylene oxides. Liquid crystalline polyesters and polyarylates are also known, such as disclosed in U.S. Pat. Nos. 4,891,293; 4,973,539; 5,039,773; 5,082,919 and 4,954,412 wherein the polyesters are comprised of at least two and preferably three spacer moieties.

Polyimide resins and, more specifically, liquid crystalline polymide resins are also known such as summarized and illustrated in the Encyclopedia of Polymer Science and Engineering, 2nd edition, Volume No. 12, published by Wiley (1985). However, the polyimide resins mentioned are believed to be fully aromatic and useful as high performance materials, and no mention for use as toners is described. Also, liquid crystalline polyimide with flexible diamino alkane moieties and, more specifically, polyoxyalkylene moieties are not mentioned.

Illustrated in the following copending applications, the disclosures of each being totally incorporated herein by reference, are:

U.S. Ser. No. 144,075, illustrates a toner composition comprised of a pigment and a crosslinked polyimide; and wherein the crosslinked polymide can be obtained from the reaction of a peroxide with an unsaturated polymide of the formula

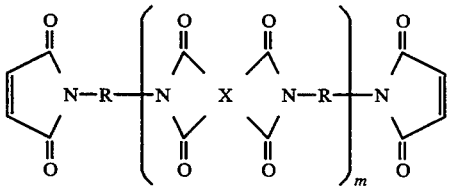

wherein X is

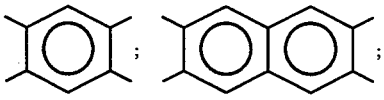

-continued

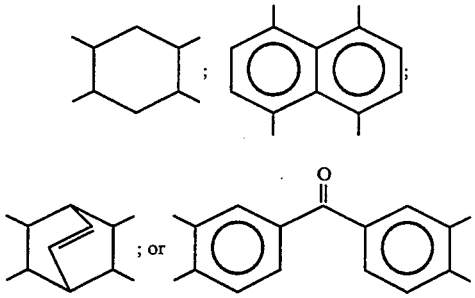

R is alkyl or oxyalkylene and m represents the number of monomer segments present and is a number of from about 10 to about about 1,000.

U.S. Ser. No. 144,956, illustrates a toner composition comprised of pigment, and polyimide of the formula

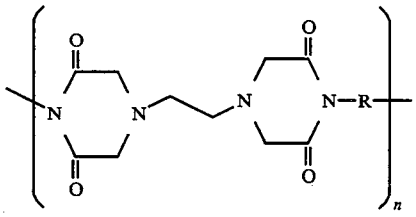

wherein n represents the number of monomer segments, and is a number of from about 10 to about 1,000; and R is alkyl, oxyalkyl, or polyoxyalkyl.

U.S. Ser. No. 144,964, illustrates a toner composition comprised of pigment, and a polyester imide resin of the formula

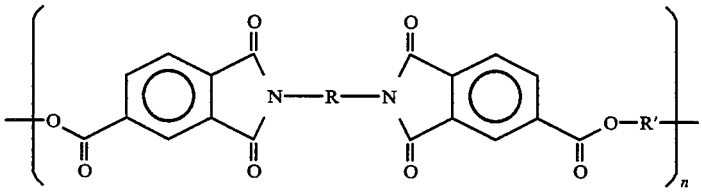

wherein n represent the number of segments present and is a number of from about 10 to about 10,000; R' is alkyl or alkylene; and R is independently selected from the group consisting of an oxyalkylene and polyoxyalkylene.

U.S. Ser. No. 144,918, illustrates a toner composition comprised of pigment, and polyimide of the formula

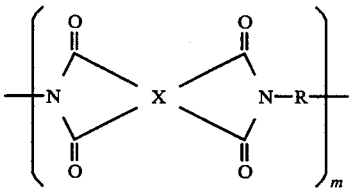

wherein m represents the number of monomer segments present; X is

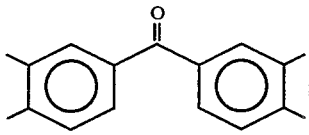

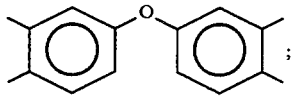

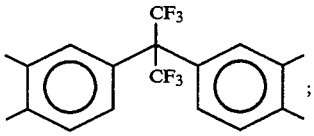

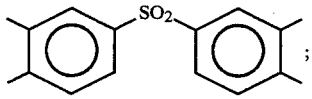

or

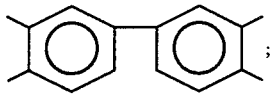

thus X can be benzophenone, oxydiphthalic, hexafluoropropane diphenyl, diphenyl sulfone, or biphenyl; and X is attached to four imide carbonyl moieties; and R is independently selected from the group consisting of alkyl, oxyalkylene and polyoxyalkylene.

SUMMARY OF THE INVENTION it is an object of the present invention to provide toner and developer compositions with many of the advantages illustrated herein.

In another object of the present invention there are provided toner compositions with thermotropic liquid crystalline polyimides or anisotropic polyimides, and which toners are useful for the development of electrostatic latent images including color images.

In yet another object of the present invention there are provided processes for the preparation of thermotropic liquid crystalline polyimides or anisotropic polyimides.

Moreover, in another object of the present invention there are provided toner compositions comprised of thermotropic liquid crystalline polyimides or anisotropic polyimides with low melt fusing temperatures of from about 130° C. to about 145° C.

Also, in another object of the present invention there are provided toner compositions comprised of thermotropic liquid crystalline polyimides or anisotropic polyimides with low melt fusing temperatures of from about 130° C. to about 145° C. and broad fusing latitude of from about 30° C. to about 60° C.

Moreover, in another object of the present invention there are provided toner compositions comprised of thermotropic liquid crystalline polyimides or anisotropic polyimides with glass transition temperatures of from about 50° C. to about 65° C.

In yet another object of the present invention there are provided toner compositions comprised of thermotropic liquid crystalline polyimides with a number average molecular weight of from about 1,500 grams per mole to about 100,000 gram per mole as measured by GPC.

In yet in another object of the present invention there are provided developer compositions comprised of a toner which displays a high projection efficiency on a transparency, such as from about 60 to about 99 percent projection, using a Match Scan II spectrophotometer available from Diana.

Also, it is an object of the present invention to provide a toner which displays high gloss, such as from about 30 to about 60 gloss units, as measured by the Gardner Gloss metering unit.

Moreover, it is an object of the present invention to provide a toner which displays low relative sensitivity, such as from about 1.0 to about 2.3, as measured from the triboelectric charge ratio of 20 percent humidity level to 80 percent humidity level.

Another object of the present invention resides in the formation of toners which will enable the development of images in electrophotographic imaging apparatuses, which images have substantially no background deposits thereon, are substantially smudge proof or smudge resistant, and, therefore, are of excellent resolution; and further, such toner compositions can be selected for high speed electrophotographic apparatuses, that is those exceeding 70 copies per minute.

Also, in another object of the present invention there are provided developer compositions comprised of toner with unsaturated polyimides that are liquid crystalline; and wherein the toner possesses in embodiments improved setting rates and carrier particles.

These and other objects of the present invention can be accomplished in embodiments thereof by providing toner compositions comprised of thermotropic liquid crystalline polyimides or anisotropic polyimides of the formulas as illustrated herein, and pigment particles. More specifically, the present invention is directed to a toner composition comprised of a pigment, and a thermotropic liquid crystalline polyimide of the formula

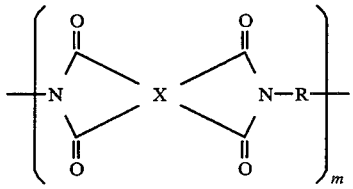

wherein m represents the number of monomer segments present; X is independently selected from the group consisting of aryl, polyaryl and a cycloaliphatic group; and R is independently selected from the group consisting of alkyl, oxyalkylene and polyoxyalkylene.

The polyimide resins of the present invention can be prepared as illustrated herein, and more specifically by charging a reactor equipped with a bottom drain valve, double turbine agitator and distillation receiver with a cold water condenser with from about 0.95 to about 1.05 mole of mesogenic monomer, such as pyromellitic dianhydride or benzene tetracarboxylic acid, and 0.95 to about 1.05 mole of flexible diamine, such as diamino terminated polyoxypropylene available as JEFFAMINE 230 TM from Texaco Chemicals. The reactor is then heated to about 150° C. to about 170° C. with stirring for a duration of from about 3 hours whereby 0.5 to about 0.9 mole of water byproduct is collected in the distillation receiver. The mixture is then heated at from about 180° C. to about 210° C., after which the pressure is slowly reduced from atmospheric pressure to about 300 Torr over a period of from about a one hour to about 5 hour period with the collection of approximately 0.1 to about 0.3 mole of water in the distillation receiver, and wherein the total amount of water collected from the beginning of the reaction is from about 0.95 to about 1.0 mole equivalent. The reactor is then purged with nitrogen to atmospheric pressure, and the resulting poly(oxypropylene-pyromellitimide) is collected through the bottom drain valve. The glass transition temperature of the resin can then be measured to be of from about 45° C. to about 65° C. (onset) utilizing the 910 Differential Scanning Calorimeter available from DuPont operating at a heating rate of 10° C. per minute. The number average molecular weight can be measured to be of from about 1,500 grams per mole to about 100,000 gram per mole by vapor phase calorimetry.

Specific examples of thermotropic liquid crystalline polyimide resins of the present invention include poly(2-methylpentyl pyromellitimide), poly(hexyl pyromellitimide), poly(octyl pentyl pyromellitimide), poly(-dodecyl pentyl pyromellitimide), poly(trimethythexyl pyromellitimide), poly(diethoxy pyromellitimide), poly(triethoxy pyromellitimide), poly(diisopropoxy pyromellitimide), poly(trisopropoxy pyromellitimide), poly(tetraisopropoxy pyromellitimide), poly(pentisopropoxy pyromellitimide), poly(dodecyl pyromellitimide), poly(2-methylpentyl bicyclo[2.2.2]oct-7-ene-2,3,5,6-diimide), poly(dodecyl bicyclo[2.2.2]oct-7-ene-2,3,5,6-diimide), poly(polyisoproxy bicyclo[2.2.2]oct-7-ene-2,3,5,6-diimide),, poly(polyisopropoxy 1,2,4,5-cyclohexanediimide), poly(2-methylpentyl 1,2,4,5-cyctohexanediimide), poly(dodecyl 1,2,4,5-cyclohexanediimide), poly(JEFFAMINE D-230 TM -pyromellitimide), poly(JEFFAMINE D-230 TM -pyromellitimide), poly(-JEFFAMINE D-400 TM -pyromellitimide), copoly(-JEFFAMINE D-230 TM -pyromellitimide)-copoly(-JEFFAMINE D-400 TM -pyromellitimide), poly(JEFFAMINE EDR-192 TM -pyromellitimide), poly(JEFFAMINE EDR-148 TM -pyromellitimide), poly(JEFFAMINE D-230 TM -bicyclo[2.2.2]oct-7-ene-2,3,5,6-diimide), (JEFFAMINE D-400 TM -bicyclo[2.2.2]oct-7-ene-2,3,5,6-diimide), poly(JEFFAMINE TM -1,2,4,5-cyclohexanediimide), mixtures thereof and the like, which resin is present in various effective amounts such as from about 75 and preferably 85 percent by weight to about 98 percent by weight of the toner comprised of, for example, resin and pigment.

Specific examples of symmetrical mesogenic monomers that can be utilized to prepare the thermotropic liquid crystalline polyimide include pyromellitic dianhydride, pyromellitic tetracarboxylic acid, bicyclo[2.2.-2]oct-7-ene-2,3,5,6-tetracarboxylic acid, bicyclo[2.2.-2]oct-7-ene-2,3,5,6-tetracarboxylic dianhydride, 1,2,4,5-cyclohexanetetracarboxylic acid, 1,2,4,5-cyclohexanetetracarboxylic dianhydride, 1,4,5,8-naphthalenetetracarboxylic dianhydride, 3,4,9,10-perylenetetracarboxylic dianhydride, 5-(2,5-dioxotetrahydrol)-3-methyl-3-cyclohexene-1,2-dicarboxylic dianhydride, mixtures thereof and the like selected in an effective amount of, for example, from about 0.45 to about 0.55 mole equivalent of polyimide.

Specific examples of diamino alkanes or diamino alkylene oxides that can be utilized to prepare the thermotropic liquid crystalline polyimide include diaminoethane, diaminopropane, 2,3-diaminopropane, diaminobutane, diaminopentane, diamino-2-methylpentane also known as DYTEK A TM available from DuPont Chemical Company, diaminohexane, diaminotrimethylhexane, diaminoheptane, diaminooctane, diaminononane, diaminodecane, diaminododecane, diaminoterminated-ethylene-oxide, diaminoterminated-diethylene oxide available as JEFFAMINE EDR-148 TM from Texaco Chemicals, diaminoterminated-diethylene oxide available as JEFFAMINE EDR-148 TM from Texaco Chemicals, diaminoterminated-triethylene oxide available as JEFFAMINE EDR-192 TM from Texaco Chemicals, diaminoterminated polyoxypropylene oxide available as JEFFAMINE D-230 TM, JEFFAMINE 400 TM, JEFFAMINE 700 TM all available from Texaco Chemicals, mixtures thereof and the like, and which component is selected in an effective amount of, for example, from about 0.45 mole equivalent to about 0.55 mole equivalent of polyimide resin.

Specific examples of kinking nonsymmetrical monomers that can be utilized to prepare the thermotropic liquid crystalline polyimide include 1,3-diaminocyclohexane, 2,4-toluene diamine, p-phenylene diamine, 2,2'-bis(4-aminophenyl) hexafluoropropane, 2,2-bis(3-amino-4-methylphenyl)-hexafluoropropane, 2,2-bis(3-amino-4-hydroxy-phenyl) hexafluoropronane, 3,3'-diamino-4,4'-dihydroxy-biphenyl,3,3'-diamethyl-4,4'-diaminobiphenyl, 3,4'-oxydianiline, 3,3-diamino-diphenylsulfone, 9,9-bis(4-aminophenyl) fluorene, mixture thereof and the like, and which component is selected in an effective amount of, for example, from about 0 to about 0.3 mole equivalent of the polyimide resin.

Various known colorants present in the toner in an effective amount of, for example, from about 1 to about 25 percent by weight of toner, and preferably in an amount of from about 1 to about 10 weight percent, that can be selected include carbon black like REGAL 330® magnetites, such as Mobay magnetites MO8029 TM, MO8060 TM; Columbian magnetites; MAPICO BLACKS TM and surface treated magnetites; Pfizer magnetites CB4799 TM, CB5300 TM, CB5600 TM, MCX6369 TM; Bayer magnetites BAYFERROX 8600 TM, 8610 TM; Northern Pigments magnetites, NP-604 TM, NP-608 TM; Magnox magnetites TMB-100 TM or TMB-104 TM; and other equivalent black pigments. As colored pigments there can be selected known cyan, magenta, yellow, red, green, brown, blue or mixtures thereof. Specific examples of pigments include HELIOGEN BLUE L6900 TM, D6480 TM, D7080 TM, D7020 TM, PYLAM OIL BLUE TM and PYLAM OIL YELLOW TM, PIGMENT BLUE 1 TM available from Paul Uhlich & Company, Inc., PIGMENT VIOLET 1 TM, PIGMENT RED 48 TM, LEMON CHROME YELLOW DCC 1026 TM, E. D. TOLUIDINE RED TM and BON RED C TM available from Dominion Color Corporation, Ltd., Toronto, Ontario, NOVAperm YELLOW FGL TM, HOSTAPERM PINK E TM from Hoechst, and CINQUASIA MAGENTA TM available from E. I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, C Solvent Red 19, and the like. Illustrative examples of cyan materials that may be used as pigments include copper tetra-(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK TM, and cyan components may also be used as pigments. The pigments are selected in various effective amounts of, for example, from about 1 weight percent to about 65 weight percent of the toner.

The toner may also include in effective amounts, such as from about 0.1 to about 10, and preferably 3 weight percent, known charge additives such as alkyl pyridinium halides, bisulfates, the charge control additives of U.S. Pat. Nos. 3,944,493; 4,007,293; 4,079,014; 4,394,430, and 4,560,635, which illustrates a toner with a distearyl dimethyl ammonium methyl sulfate charge additive, the disclosures of which are totally incorporated herein by reference, and the like.

Surface additives in effective amounts, such as from about 0.1 to about 3 weight percent, that can be added to the toner compositions of the present invention include, for example, metal salts, metal salts of fatty acids, colloidal silicas, mixtures thereof and the like, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa. Also, waxes, especially of a molecular weight of about 1,000 to about 20,000, and preferably about 10,000, such as polypropylene, polyethylene, and the like can be added to the toner.

In another embodiment of the present invention there are provided, subsequent to known micronization and classification, toner particles with an average volume diameter as determined by a Coulter Counter of from about 5 to about 20, and preferably 15 microns comprised of thermotropic liquid crystalline polyimide resin, pigment particles, and optional charge enhancing additives.

The thermotropic liquid crystalline polyimide resin is present in a sufficient, but effective, amount, for example from about 70 to about 98, and preferably from about 80 to about 95 weight percent. Thus, when 1 percent by weight of the charge enhancing additive is present, and about 3 to 10 percent by weight of pigment or colorant, such as carbon black, is contained therein, about 96 to about 89 percent by weight of resin is selected. Also, the charge enhancing additive may be coated on the pigment particles.

Developer compositions include carrier particles, and the polyimide toners illustrated herein; examples of carriers being steel, iron, ferrites, silicon oxides, and the like, reference for example U.S. Pat. Nos. 4,937,166 and 4,935,326, the disclosures of which are totally incorporated herein by reference.

The toner and developer compositions of the present invention may be selected for use in electrostatographic imaging and printing apparatuses containing therein conventional photoreceptors Thus, the toner and developer compositions of the present invention can De used with layered photoreceptors or photoconductive components that are capable of being charged negatively, such as those described in U.S. Pat. Nos. 4,265,990, the disclosure of which is totally incorporated herein, by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The following Examples are being supplied to further define various species of the present invention, it being noted that these Examples are intended to illustrate and not limit the scope of the present invention. Parts and percentages are by weight unless otherwise indicated.

EXAMPLE I

A thermotropic liquid crystalline polyimide derived from pyromellitic dianhydride and diaminoterminated polyoxypropylene with an average molecular weight of 230 and available as JEFFAMINE D-230 TM from Texaco Chemical Company was prepared as follows:

Pyromellitic dianhydride (80 grams) and JEFFAMINE D-230 TM (81 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes, and then the reactor temperature was increased to 225° C. for 30 minutes. The bottom drain of the reactor was then opened, and the product thermotropic liquid crystalline poly(JEFFAMINE D-230 TM or dioxypropylene-pyromellitimide) resin product as identified by its X-ray diffraction pattern was allowed to pour into a container cooled with dry ice to yield 120 grams of product. The number average molecular weight of the resin resulting was then measured to be 24,100 grams per mole by vapor phase osmometry using toluene as the solvent. The glass transition temperature of the resin was measured using the E. I. DuPont Differential Scanning Calorimeter at 10° C. per minute. The softening temperature, beginning of flow temperature ($T_1$), and flow temperature ($T_2$) were measured by selecting 1.8 grams of the aforementioned polyimide resin pressed into a pellet and subjecting it to the Shimadzu-500 Flowtester operated from room temperature to 130° C. at 10° C. per minute and utilizing a load of 20 killigrams with a die diameter and length of 1 millimeter by 2 millimeters. For the thermotropic liquid crystalline poly(oxypropylene-1,2,4,5-benzene diimide pyromellitimide) of this Example, a glass transition temperature of 72° C., a softening point of 90° C., a beginning of flow temperature of 96° C., and flow temperature ($T_2$) of 120° C. were obtained.

EXAMPLE II

A thermotropic liquid crystalline polyimide derived from pyromellitic dianhydride and diaminoterminated polyoxypropylene with an average molecular weight of 400 and available as JEFFAMINE D-400 TM from Texaco Chemical Company was prepared as follows:

Pyromellitic dianhydride (80 grams) and JEFFAMINE D-400 TM (140 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the thermotropic liquid crystalline poly(JEFFAMINE D-400 TM or tetraoxypropylene-pyromellitimide) resin was allowed to pour into a container cooled with dry ice yielding 124 grams of product. The number average molecular weight was then measured to be 6,900 grams per mole by vapor phase osmometry using toluene as the solvent. The glass transition temperature of the resin was measured using the DuPont Differential Scanning Calorimeter at 10° C. per minute. The softening temperature, beginning of flow temperature ($T_1$), and flow temperature ($T_2$), were measured by using 1.8 grams of aforementioned polymide resin pressed into a pellet and subjecting it to the Shimadzu-500 Flowtester operated from room temperature to 130° C. at 10° C. per minute and utilizing a load of 20 killigrams with a die diameter and length of 1 millimeter by 2 millimeters. For the thermotropic liquid crystalline poly(oxypropytene-pyromellitimide) of this Example, a glass transition temperature (Tg) of −4.0° C. was measured.

EXAMPLE III

A thermotropic liquid crystalline polyimide derived from 0.5 mole equivalent of pyromellitic dianhydride, 0.44 mole equivalent of JEFFAMINE D-230 TM, and 0.06 mole equivalent of JEFFAMINE D-400 TM was prepared as follows:

Pyromellitic dianhydride (80 grams), JEFFAMINE D-230 TM (70.5 grams), and JEFFAMINE D-400 TM (24 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the thermotropic liquid crystalline copoly(-JEFFAMINE D-230 TM -pyromellitimide)-copoly(-JEFFAMINE D-400 TM -pyromellitimide) resin product was allowed to pour into a container cooled with dry ice yielding 115 grams of resin product. The number average molecular weight of the resin was then measured to be 7,200 grams per mole by vapor phase osmometry using toluene as the solvent. The glass transition temperature of the resin was measured using the Dupont Differential Scanning Calorimeter at 10° C. per minute. The softening temperature, beginning of flow temperature ($T_1$), and flow temperature ($T_2$) were measured by using 1.8 grams of aforementioned polyimide resin pressed into a pellet and subjecting it to the Shimadzu-500 Flowtester operated from room temperature to 130° C. at 10° C. per minute and utilizing a load of 20 killigrams with a die diameter and length of 1 millimeter by 2 millimeters. For the thermotropic liquid crystalline poly(oxypropylene-pyromellitimide) of this Example, a glass transition temperature of 57° C., a softening point of 73° C., a beginning of flow temperature ($T_1$) of 88° C., and flow temperature ($T_2$) of 105° C. were obtained.

EXAMPLE IV

A thermotropic liquid crystalline polyimide derived from 0.5 mole equivalent of pyromellitic dianhydride, 0.47 mole equivalent of JEFFAMINE D-230 TM, and 0.03 mole equivalent of JEFFAMINE D-400 TM was prepared as follows:

Pyromellitic dianhydride (80 grams), JEFFAMINE D-230 TM (76 grams), and JEFFAMINE D-400 TM (4 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the thermotropic liquid crystalline copoly(JEFFAMINE D-230 TM -pyromellitimide)-copoly(JEFFAMINE D-400 TM -pyromellitimide) resin product was allowed to pour into a container cooled with dry ice, and measured to be 118 grams. The number average molecular weight of the resin was then measured to be 7,200 grams per mole by vapor phase osmometry using toluene as the solvent. The glass transition temperature of the resin was measured using the DuPont Differential Scanning Calorimeter at 10° C. per minute. The softening temperature, beginning of flow temperature ($T_1$), and flow temperature ($T_2$) were measured by using 1.8 grams of aforementioned polyimide resin pressed into a pellet and subjecting it to the Shimadzu-500 Flowtester operated from room temperature to 130° C. at 10° C. per minute and utilizing a load of 20 killigrams with a die diameter and length of 1 millimeter by 2 millimeters. For the thermotropic liquid crystalline poly(oxypropylene-pyromellitimide) of this Example, a glass transition temperature of 62° C., a softening point of 80° C., a beginning of flow temperature ($T_1$) of 97° C., and flow temperature ($T_2$) of 115° C. were obtained.

EXAMPLE V

A thermotropic liquid crystalline polyimide derived from 0.5 mole equivalent of pyromellitic dianhydride, 0.40 mole equivalent of JEFFAMINE D-230 TM, and 0.20 mole equivalent of JEFFAMINE D-400 TM was prepared as follows:

Pyromellitic dianhydride (80 grams), JEFFAMINE-230 TM (64.8 grams), and JEFFAMINE D-400 TM (28 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the thermotropic liquid crystalline copoly(JEFFAMINE D-230 TM -(pyromellitimide)-copoly(JEFFAMINE D-400 TM -pyromellitimide) resin product was allowed to pour into a container cooled with dry ice, and measured to be 120 grams. The number average molecular weight was then measured to be 7,100 grams per mole by vapor phase osmometry using toluene as the solvent. The glass transition temperature of the resin was measured using the DuPont Differential Scanning Calorimeter at 10° C. per minute. The softening temperature, beginning of flow temperature ($T_1$), and flow temperature ($T_2$), were measured by using 18 grams of aforementioned polyimide resin pressed into a pellet and subjecting it to the Shimadzu -500 Flowtester operated from room temperature to 130° C. at 10° C. per minute and utilizing a load of 20 killigrams with a die diameter and length of 1 millimeter by 2 millimeters. For the thermotropic liquid crystalline poly(oxypropylene-pyromellitimide) of this Example, a glass transition temperature of 51° C., a softening point of 72° C., a beginning of flow temperature ($T_1$) of 85° C., and flow temperature ($T_2$) of 104° C. were obtained.

EXAMPLE VI

A thermotropic liquid crystalline polyimide derived from 0.5 mole equivalent of pyromellitic dianhydride, 0.40 mole equivalent of JEFFAMINE D-230 TM, 0.10 mole equivalent of JEFFAMINE D-400 TM, and 0.10 mole equivalent of 1,3-diaminobenzene as the kinking agent was prepared as follows:

Pyromellitic dianhydride (80 grams), JEFFAMINE D-230 TM (64.8 grams), and JEFFAMINE D-400 TM (14 grams) were charged into a 300 milliliter Parr reactor equipped with a mechanical stirrer, distillation receiver and bottom valve drain. The mixture was heated to 150° C. and stirred for 30 minutes, followed by increasing the temperature to 175° C. whereby water started to distill. The mixture was then maintained at 175° C. for 2 hours whereby 10 grams of water (90 percent) were collected. The reactor temperature was then increased to 200° C. with slow purging of nitrogen for 30 minutes and then increased to 225° C. for another 30 minutes. The bottom drain of the reactor was then opened, and the thermotropic liquid crystalline copoly(-JEFFAMINE D-230 TM -pyromellitimide)-copoly(-JEFFAMINE D-400 TM -pyromellitimide)-copoly(1,3-benzene-pyromellitimide) resin product was allowed to pour into a container cooled with dry ice, and yielding 125 grams of resin product. The resin number average molecular weight was then measured to be 6,900 grams per mole by vapor phase osmometry using toluene as the solvent. The glass transition temperature of the resin was measured using the DuPont Differential Scanning Calorimeter at 10° C. per minute. The softening temperature, beginning of flow temperature ($T_1$), and Flow temperature ($T_2$) were measured by using 1.8 grams of aforementioned polyimide resin pressed into a pellet and subjecting it to the Shimadzu-500 Flowtester operated from room temperature to 130° C. at 10° C. per minute and utilizing a load of 20 killigrams with a die diameter and length of 1 millimeter by 2 millimeters. For the thermotropic liquid crystalline poly(oxypropylene-pyromellitimide) of this Example, a glass transition temperature of 69° C., a softening point of 93° C., a beginning of flow temperature ($T_1$) of 112° C., and flow temperature ($T_2$) of 127° C. were obtained.

EXAMPLE VII

A toner composition comprised of 98 percent by weight of the liquid crystalline polyimide resin of Example III and 2 percent by weight of PV FAST BLUE TM pigment was prepared as follows.

The liquid crystalline polyimide resin of Example III was in the form of a large chunk. The resulting polymer was ground to about 500 microns in a Model J Fitzmill equipped with an 850 micrometer screen. After grinding, 117.6 grams (98 percent by weight of toner) of resin were mixed with 2.4 grams of PV FAST BLUE TM pigment (2 percent by weight of toner) available from Hoechst Chemical Corporation. The two components were dry blended first on a paint shaker and then on a roll mill. A small CSI TM counterrotating twin screw extruder available for Customs Scientific Instrumentations was then used to melt mix the aforementioned mixture at a barrel temperature of 140° C., screw rotational speed of 50 rpm and at a feed rate of 2 grams per minute. The extruded strands were broken into coarse particles utilizing a coffee bean grinder available from Black and Decker. An 8 inch Sturtevant micronizer was used to reduce the particle size further. After grinding, the toner was measured to display an average volume diameter particle size of 7.1 microns with a geometric distribution of 1.39 as measured by the Coulter Counter. The resulting toner was then utilized without further classification. A developer composition was prepared by roll milling the aforementioned toner, 3 parts by weight with 100 parts by weight of carrier available from Xerox Corporation and comprised of a steel core, 90 microns in diameter, with a polyvinylidene polymer coating, 0.175 percent coating weight thereof. Tribo data was obtained using the known blow-off Faraday Cage apparatus, and the toner developer was subjected to 20 percent humidity in a chamber for 48 hours, and to 80 percent humidity level in a chamber for 48 hours. The ratio of the corresponding triboelectric charge at 20 percent RH to 80 percent RH determined as indicated herein was measured to be 1.9. Unfused copies were then produced with the above prepared toner using a Xerox Corporation 1075 imaging apparatus with the fusing system disabled. The unfused copies were then subsequently fused on a laboratory test VITON ® coated fuser fixture using a process speed of 11.9 inches per second. Fusing evaluation of the toner indicated a minimum fixing temperature of about 125° C., and no hot-offset temperature was observed at the maximum temperature of 200° C. evaluated.

EXAMPLE VIII

A toner composition comprised of 98 percent by weight of the liquid crystalline polyimide resin of Example IV and 2 percent by weight of PV FAST BLUE TM pigment was prepared as follows.

The liquid crystalline polyimide resin of Example III was in the form of a large chunk. The resulting polymer was ground to smaller particles in a Model J Fitzmill equipped with an 850 micrometer screen. After grinding, 117.6 grams (98 percent by weight of toner) of resin was mixed with 2.4 grams of PV FAST BLUE TM pigment (2 percent by weight of toner) available from Hoechst Chemical Corporation. The two components were dry blended first on a paint shaker and then on a roll mill. A small CSI TM counterrotating twin screw extruder, available from Customs Scientific Instrumentations, was then used to melt mix the aforementioned mixture at a barrel temperature of 140° C., screw rotational speed of 50 rpm and at a feed rate of 2 grams per minute. The extruded strands were broken into coarse particles utilizing a coffee bean grinder available from Black and Decker. An 8 inch Sturtevant micronizer was used to reduce the particle size further. After grinding, the toner was measured to display an average volume diameter particle size of 8.1 microns with a geometric distribution of 1.40 as measured by the Coulter Counter. The resulting toner was then utilized without further classification. A developer composition was prepared by roll milling the aforementioned toner, 3 parts by weight with 100 parts by weight of the carrier of Example VII comprised of a steel core with polyvinylidene polymer coating thereof. Tribo data was obtained using the known blow-off Faraday Cage apparatus, and the toner developer was subjected to 20 percent humidity in a chamber for 48 hours, and at an 80 percent humidity level in a chamber for 48 hours. The ratio of the corresponding triboelectric charge at 20 percent RH to 80 percent RH was measured to be 1.7. Unfused copies were then produced with the above toner using a Xerox Corporation 1075 imaging apparatus with the fusing system disabled. The unfused copies were then subsequently fused on a customized VITON® coated fuser using a process speed of 11.9 inches per second. Fusing evaluation of the toner indicated a minimum fixing temperature of about 135° C., and no hot-offset temperature was observed at the maximum temperature of 200° C. evaluated.

EXAMPLE IX

A toner composition comprised of 98 percent by weight of the liquid crystalline polyimide resin of Example V and 2 percent by weight of PV FAST BLUE TM pigment was prepared as follows.

The liquid crystalline polyimide resin of Example IV was in the form of a large chunk. The resulting polymer was ground to smaller particles in a Model J Fitzmill equipped with an 850 micrometer screen. After grinding, 117.6 grams (98 percent by weight of toner) of resin were mixed with 2.4 grams of PV FAST BLUE TM pigment (2 percent by weight of toner) available from Hoechst Chemical Corporation. The two components were dry blended first on a paint shaker and then on a roll mill. A small CSI TM counterrotating twin screw extruder available from Customs Scientific Instrumentations was then used to melt mix the aforementioned mixture at a barrel temperature of 140° C., screw rotational speed of 50 rpm, and at a feed rate of 2 grams per minute. The extruded strands were broken into coarse particles utilizing a coffee bean grinder available from Black and Decker. An 8 inch Sturtevant micronizer was used to reduce the particle size further. After grinding, the toner was measured to display an average volume diameter particle size of 9.0 microns with a geometric distribution of 1.40 as measured by the Coulter Counter. The resulting toner was then utilized without further classification. A developer composition was prepared by roll milling the aforementioned toner, 3 parts by weight with 100 parts by weight of the carrier of Example VII comprised of a steel core with polyvinylidene polymer coating thereof. Tribo data was obtained using the known blow-off Faraday Cage apparatus, and the toner developer was subjected to 20 percent humidity in a chamber for 48 hours, and at 80 percent humidity level in a chamber for 48 hours. The ratio of the corresponding triboelectric charge at 20 percent RH to 80 percent RH was measured to be 1.55. Unfused copies were then produced with the above toner using a Xerox Corporation 1075 imaging apparatus with the fusing system disabled. The unfused copies were then subsequently fused on a customized VITON® coated fuser using a process speed of 11.9 inches per second. Fusing evaluation of the toner indicated a minimum fixing temperature of about 130° C., and no hot-offset temperature was observed at the maximum temperature of 200° C. evaluated.

EXAMPLE X

A toner composition comprised of 94 percent by weight of the liquid crystalline polyimide resin of Example III and 6 percent by weight of REGAL 330® black pigment was prepared as follows.

The liquid crystalline polyimide resin of Example IV was in the form of a large chunk. The resulting polymer was ground to smaller particles in a Model J Fitzmill equipped with an 850 micrometer screen. After grinding, 188 grams (94 percent by weight of toner) of resin were mixed with 12 grams of REGAL 330® (6 percent by weight of toner). The two components were dry blended first on a paint shaker and then on a roll mill. A small CSI TM counterrotating twin screw extruder available from Customs Scientific Instrumentations was then used to melt mix the aforementoned mixture at a barrel temperature of 140° C., screw rotational speed of 50 rpm and at a feed rate of 2 grams per minute. The extruded strands were broken into coarse particles utilizing a coffee bean grinder available from Black and Decker. An 8 inch Sturtevant micronizer was used to reduce the particle size further. After grinding, the toner was measured to display an average volume diameter particle size of 9.1 microns with a geometric distribution of 1.38 as measured by the Coulter Counter. The resulting toner was then utilized without further classification. A developer composition was prepared by roll milling the aforementioned toner, 3 parts by weight with 100 parts by weight of the carrier of Example VII comprised of a steel core with polyvinylidene polymer coating thereof, 1.25 percent. Tribo data was obtained using the known blow-off Faraday Cage apparatus, and the toner developer was subjected to 20 percent humidity in a chamber for 48 hours, and at 80 percent humidity level in a chamber for 48 hours. The ratio of the corresponding triboelectric charge at 20 percent RH to 80 percent RH was measured to be 1.55. Unfused copies with the above prepared toner were then generated using a Xerox Corporation 1075 imaging apparatus with the fusing system disabled. The unfused copies were then subsequently fused utilizing the 1075 fuser at a process speed of 11.9 inches per second. Fusing evaluation of the toner indicated a minimum fixing temperature, a hot-offset temperature of 175° C., and a fusing latitude of 50° C.

Other embodiments and modifications of the present invention may occur to those skilled in the art subsequent to a review of the information presented herein; these embodiments and modifications, as well as equivalents thereof, are also included within the scope of this invention.

What is claimed is:

1. A toner comprised of a pigment, and a thermotropic liquid crystalline polyimide of the formula

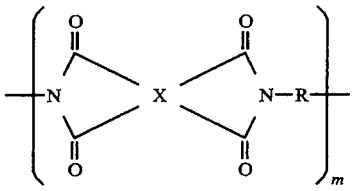

wherein m represents the number of monomer segments present; X is a symmetrical moiety independently selected from the group consisting of phenyl, naphthyl, cyclohexyl, or bicycloaliphatic; and R is independently selected from the group consisting of alkyl, oxyalkylene and polyoxyalkylene.

2. A toner in accordance with claim 1 wherein R is alkyl with from 1 to about 25 carbon atoms.

3. A toner in accordance with claim 1 wherein R is methyl, ethyl, propyl, butyl, pentyl, hexyl, heptyl, octyl, nonyl, decyl, undecyl, dodecyl, stearyl, lauryl, or mixtures thereof.

4. A toner in accordance with claim 1 wherein X is selected from the group consisting of bicyclo[2.2.2]oct-7-ene, perylene, and mixtures thereof.

5. A toner in accordance with claim 1 wherein R is an oxyalkylene selected from the group consisting of diethylene oxide, dipropylene oxide, triethylene oxide, tripropylene oxide, tetraethylene oxide, tetrapropylene oxide, pentaethylene oxide, pentapropylene oxide, polypropylene oxide, and mixtures thereof.

6. A toner in accordance with claim 1 wherein the thermotropic liquid crystalline polyimide resin is selected from the group consisting of poly(2-methylpentyl pyromellitimide), poly(hexyl pyromellitimide), poly(octyl pentyl pyromellitimide), poly(dodecyl pentyl pyromellitimide), poly(trimethylhexyl pyromellitimide), poly(diethoxy pyromellitimide), poly(triethoxy pyromellitimide), poly(diisopropoxy pyromellitimide), poly(trisopropoxy pyromellitimide), poly(tetraisopropoxy pyromellitimide), poly(pentisopropoxy pyromellitimide), poly(dodecyl pyromellitimide), poly(2-methylpentyl bicyclo[2.2.2]oct-7-ene-2,3,5,6-diimide), poly(dodecyl bicyclo[2.2.2]oct-7-ene-2,3,5,6-diimide), poly(polyisopropoxy bicyclo[2.2.2]oct-7-ene-2,3,5,6-diimide), poly(polyisopropoxy 1,2,4,5-cyclohexanediimide), poly(2-methylpentyl 1,2,4,5-cyclohexanediimide), poly(dodecyl 1,2,4,5-cyclohexanediimide), poly(dioxypropylene-pyromellitimide), poly(dioxypropylene-pyromellitimide), and mixtures thereof.

7. A toner in accordance with claim 1 wherein the thermotropic liquid crystalline polyimide has a $M_n$ of from about 1,500 to about 20,000, and an $M_w$ of from about 2,500 to about 100,000.

8. A toner in accordance with claim 1 which possesses a low fixing temperature of from about 120° C. to about 145° C. and a broad fusing latitude of from about 40° C. to about 120° C.

9. A toner in accordance with claim 1 wherein the thermotropic liquid crystalline polyimide is obtained from the reaction of from about 0.40 mole equivalent to about 0.55 mole equivalent of a dianhydride, from about 0.40 mole equivalent to about 0.55 mole equivalent of a diamine, and optionally of from about 0.05 mole equivalent to about 0.2 mole equivalent of a kinking nonsymmetrical monomer.

10. A toner in accordance with claim 9 wherein the dianhydride is selected from the group consisting of pyromellitic dianhydride, pyromellitic tetracarboxylic acid, bicyclo[2.2.2]oct-7-ene-2,3,5,6-tetracarboxylic acid, bicyclo[2.2.2]oct-7-ene-2,3,5,6-tetracarboxylic dianhydride, 1,2,4,5-cyclohexanetetracarboxylic acid, 1,2,4,5-cyclohexanetetracarboxylic dianhydride, 1,4,5,8-naphthalene tetracarboxylic dianhydride, 3,4,9,10-perylenetetracarboxylic dianhydride, and 5-(2,5-dioxotetrahydrol)-3-methyl-3-cyclohexene-1,2-dicarboxylic dianhydride.

11. A toner in accordance with claim 9 wherein the diamine selected from the group consisting of diaminoethane, diaminopropane, 2,3-diaminopropane, diaminobutane, diaminopentane, diamino-2-methylpentane diaminohexane, diaminotrimethylhexane, diaminoheptane, diaminooctane, diaminononane, diaminodecane, diaminododecane, diaminoterminated diethyleneoxide, diaminoterminated triethyleneoxide, and a polyoxyalkylene of the formula

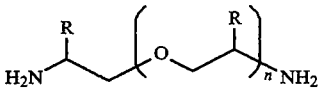

wherein R represents a hydrogen or alkyl group; and n represents the number of monomer segments, and is a number of from about 1 to about 10.

12. A toner in accordance with claim 9 wherein the kinking monomer is selected from the group consisting of 1,3-diaminocyclohexane, 2,4-toluene diamine, p-phenylene diamine, 2,2'-bis(4-aminophenyl) hexafluoropropane, 2,2-bis(3-amino-4-methylphenyl) hexafluoropropane, 2,2-bis(3-amino-4-hydroxy-phenyl) hexafluoropropane, 3,3'-diamino-4,4'-dihydroxy-biphenyl, 3,3'-dimethyl-4,4'-diaminobiphenyl, 3,4'-oxydianiline, 3,3-diamino-diphenylsulfone, 9,9-bis(4-aminophenyl) fluorene, and mixtures thereof; and n is a number of from about 1 to about 0.3 mole equivalent of the polyimide resin.

13. A toner composition in accordance with claim 1 with a glass transition temperature thereof of from about 50° C. to about 65° C.

14. A toner composition in accordance with claim 1 with a relative humidity sensitivity of from about 1.01 to about 2.3.

15. A toner composition in accordance with claim 1 further including a charge enhancing additive incorporated into the toner, or present on the surface of the toner.

16. A toner composition in accordance with claim 1 further containing a wax component with a weight average molecular weight of from about 1,000 to about 10,000.

17. A toner composition in accordance with claim 1 further containing as external additives metal salts of a fatty acid, colloidal silicas, or mixtures thereof.

18. A toner composition in accordance with claim 1 wherein the pigment is carbon black, magnetites, or mixtures thereof, cyan, magenta, yellow, red, blue, green, brown, or mixtures thereof.

19. A developer composition comprised of the toner composition of claim 1 and carrier particles.

20. A developer composition in accordance with claim 19 wherein the carrier particles are ferrites, steel, or an iron powder with an optional coating.

21. A method of imaging which comprises formulating an electrostatic latent image on a negatively charged photoreceptor, affecting development thereof with the toner composition of claim 1, and thereafter transferring the developed image to a suitable substrate.

22. A toner in accordance with claim 1 wherein m is a number of from about 10 to about 10,000.

23. A toner in accordance with claim 1 wherein m is a number of from about 10 to about 100, and oxalkylene and polyoxyalkylene contain from about 1 to about 15 carbon atoms.

* * * * *